US005937585A

United States Patent [19]

Tidbury et al.

[11] Patent Number: 5,937,585

[45] Date of Patent: Aug. 17, 1999

[54] ANTI-RATTLE DOOR ASSEMBLY

[75] Inventors: John Tidbury; Dilip Mistry, both of Oxon, United Kingdom

[73] Assignee: Rover Group Limited, Warwick, United Kingdom

[21] Appl. No.: 08/815,807

[22] Filed: Mar. 12, 1997

[30] Foreign Application Priority Data

Mar. 21, 1996 [GB] United Kingdom ..... 9605942

[51] Int. Cl.[6] ..... E06B 1/04

[52] U.S. Cl. ..... 49/504; 292/DIG. 39

[58] Field of Search ..... 49/381, 400, 503, 49/504, 394; 292/DIG. 39, DIG. 40, DIG. 55; 403/381

[56] References Cited

U.S. PATENT DOCUMENTS

| | | | |
|---|---|---|---|
| 1,089,193 | 3/1914 | Ervien | 292/DIG. 39 |
| 1,329,313 | 1/1920 | Seabury et al. | 292/DIG. 39 |
| 1,437,635 | 12/1922 | Damiani | 292/DIG. 39 |
| 1,447,271 | 3/1923 | Soss . | |
| 1,482,041 | 1/1924 | Sorenson | 292/DIG. 39 |
| 1,605,211 | 11/1926 | Bourgon | 292/DIG. 39 |
| 1,694,297 | 12/1928 | Whittington | 292/DIG. 39 |
| 1,766,183 | 6/1930 | Mealia | 292/DIG. 39 |
| 1,768,458 | 6/1930 | Wells | 292/DIG. 39 |
| 1,840,786 | 1/1932 | Moore | 292/DIG. 39 |
| 1,865,875 | 7/1932 | Moore et al. | 292/DIG. 39 |
| 1,888,830 | 11/1932 | Moore | 292/DIG. 39 |
| 1,891,289 | 12/1932 | Thomas . | |
| 1,965,672 | 7/1934 | Seitz | 292/DIG. 39 |
| 2,210,989 | 8/1940 | Sutherland | 292/DIG. 40 |
| 2,215,914 | 9/1940 | Coffey | 292/DIG. 40 |
| 4,057,294 | 11/1977 | Krekeler | 403/381 |
| 5,421,124 | 6/1995 | Zuccaro | 49/381 |
| 5,628,148 | 5/1997 | Beutler | 49/394 |

FOREIGN PATENT DOCUMENTS

| | | |
|---|---|---|
| 1 070 524 | 12/1955 | Germany . |
| 339473 | 11/1930 | United Kingdom . |
| 560255 | 3/1944 | United Kingdom . |

*Primary Examiner*—Daniel P. Stodola
*Assistant Examiner*—Curtis Cohen
*Attorney, Agent, or Firm*—Davis and Bujold

[57] ABSTRACT

An anti-rattle door assembly for a vehicle comprising a first member on the vehicle door and a second member on a part of the vehicle defining the door. The first member having a guide for directing alignment between the first and second members and two independently slidable wedge shaped members that engage with a tapering recess formed within the second member. Once engaged, the two wedge members prevent relative vertical movement between the members thereby reducing door rattle.

17 Claims, 5 Drawing Sheets

ANTI-RATTLE DOOR ASSEMBLY

FIELD OF THE INVENTION

This invention relates to a anti-rattle vehicle door assembly and to a vehicle door incorporating such an assembly.

BACKGROUND OF THE INVENTION

Known within the prior art are anti-rattle door assemblies having a door opening formed with a wedge-shaped recess therein and a spring biased wedge-shaped projection secured to the door.

When the door is closed, the narrower end of the wedge-shaped projection enters the wider end of the recess so that there is initial abutment between the wedge and recess. The biasing action of the spring then biases the wedge into full engagement with the recess thereby reducing rattling of the door.

If the door is large, or if the door is a rear door of a vehicle upon which is mounted a spare wheel, the weight of the door may be sufficient to cause the door to drop slightly thereby creating misalignment between the wedge and the wedge recess. This weight may also make it difficult to obtain a smooth latching of the door due to the consequential misalignment between the door and an associated latching mechanism on the door opening.

OBJECT OF THE INVENTION

It is an object of the present invention to provide an improved anti-rattle door assembly.

SUBJECT OF THE INVENTION

According to the invention, there is provided an anti-rattle assembly for a vehicle door comprising a first member for attachment to a door and a second member for attachment to a part of the vehicle defining a door opening, the first member having a backplate attached to the door, at least one wedge shaped member slidingly supported by the backplate and a spring means to bias the at least one wedge shaped member, and the second member having a plate defining a tapering recess for cooperation with the at least one wedge shaped member for attachment to the part defining the door opening, wherein the first member has a guide member attached thereto for engagement with a surface of said tapering recess during closure of the door so as to align the first and second members as the door is closed.

Preferably there are two independently slidable wedge shaped members independently biased by said spring means.

Also according to the invention, there is provided a vehicle door comprising an anti-rattle assembly and a latch mounted on the door cooperatingly aligned with a striker mounted on the vehicle, the anti-rattle assembly comprising a first member and a second member for attachment to a part of the vehicle defining a door opening, the first member having a backplate attached to the door, at least one wedge shaped member slidingly supported by the backplate and a spring means to bias the at least one wedge shaped member, and the second member having a plate defining a tapering recess for cooperation with the at least one wedge shaped member for attachment to the part defining the door opening, wherein the first member has a guide member attached thereto for engagement with a surface of said tapering recess during closure of the door so as to align the first and second members as the door is closed.

According to a second embodiment of the invention, a motor vehicle door assembly is provided that includes an anti-rattle door assembly according to the first embodiment.

BRIEF DESCRIPTION OF THE DRAWINGS

An anti-rattle vehicle door assembly in accordance with the invention will now be described, by way of example, with reference to the accompanying drawings, in which.

DETAILED DESCRIPTION OF THE PREFERRED EMBODIMENTS

Figure 1:
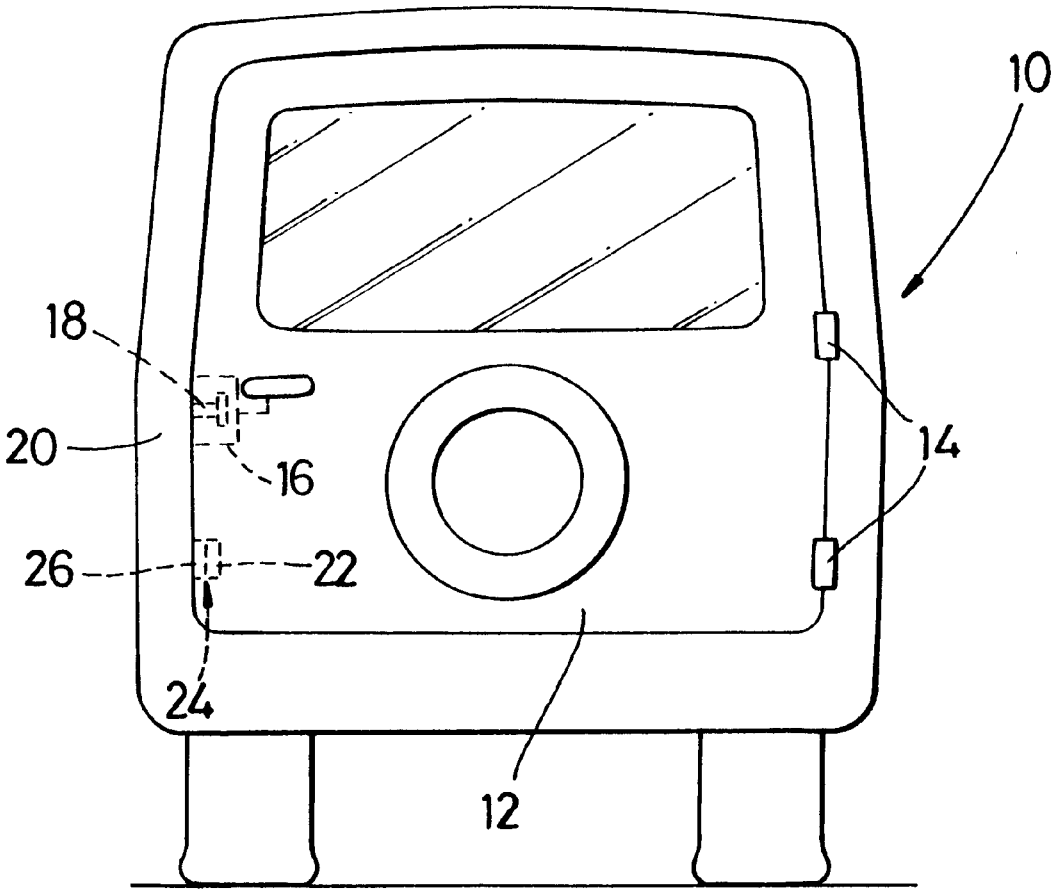
FIG. 1 is a rear view of a motor vehicle having a door with an anti-rattle assembly in accordance with the invention.

In FIG. 1, a vehicle 10 has a rear door 12 mounted to pivot about a vertical axis by two hinges 14. The door 12 is held closed by a latch 16 of known kind which cooperates with a striker 18 mounted on a door post 20 on the left hand side of the vehicle. The door 12 also carries a first member 22 of a door anti-rattle assembly 24 and the door post 20 carries a second member 26 of the anti-rattle assembly 24.

Figure 2:
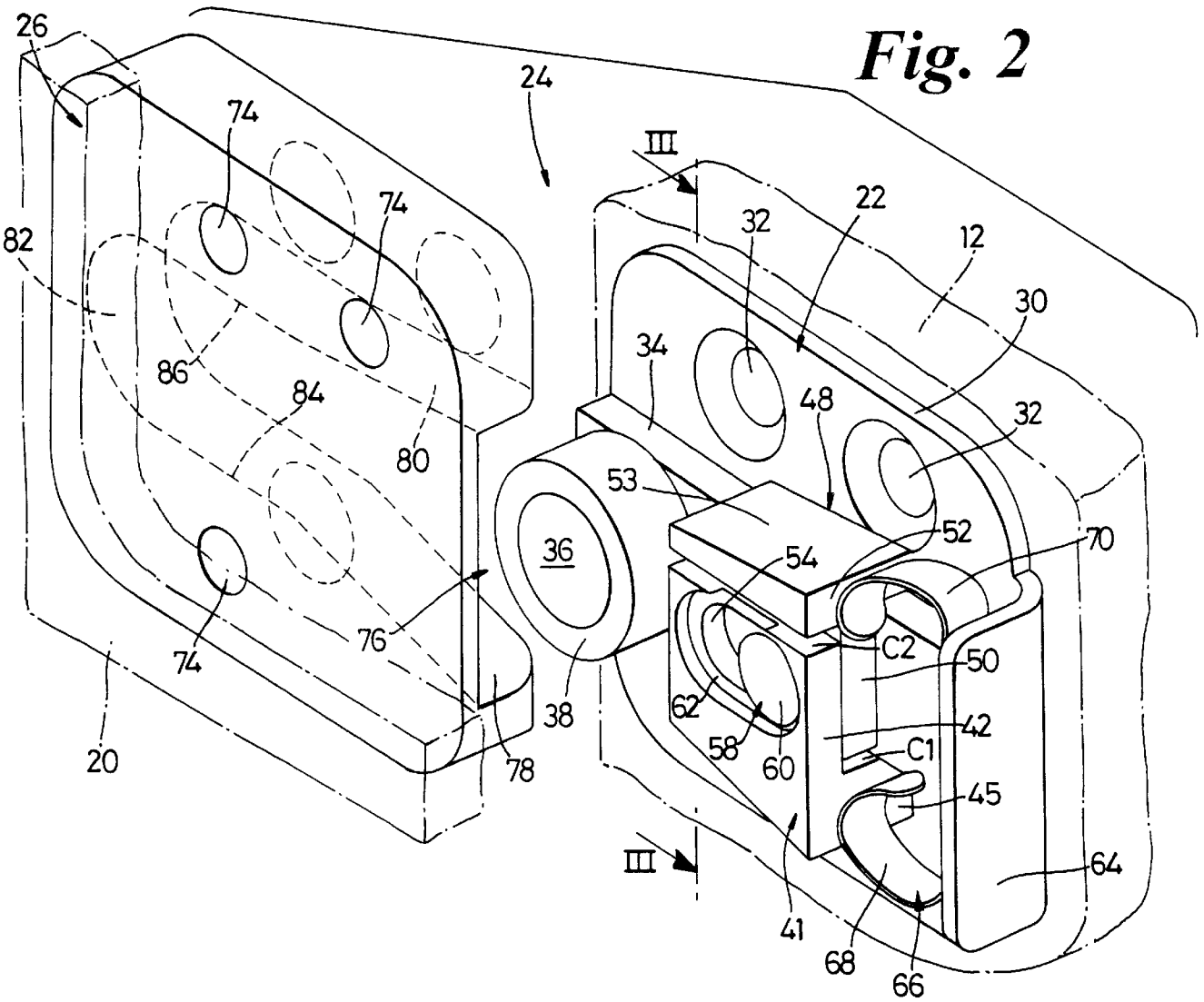
FIG. 2 is a perspective view to a large scale showing first and second members of an anti-rattle door assembly in accordance with the invention.
Figure 3:
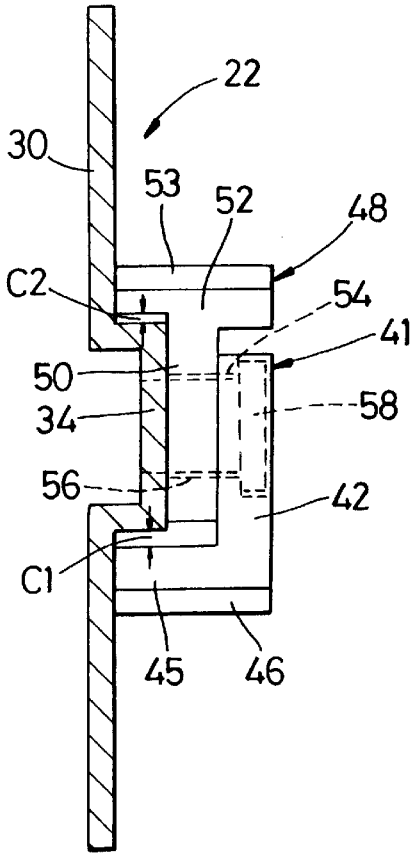
FIG. 3 is a cross-section through the first member shown in FIG. 2 on the line III—III in FIG. 2.

With reference to FIGS. 2 and 3, the first member 22 of the anti-rattle assembly 24 comprises a backplate 30 which is, in use, attached to the door 12 by suitable fasteners (not shown) which pass through the apertures 32. The backplate 30 is stamped from sheet metal and has an elongate rectangular guide rail 34 to which is secured a pin 36 on which a roller 38 is rotatably mounted.

The guide rail 34 also provides a support for first and second wedge shaped member 41, 48.

The first wedge shaped member 41 is generally L-shaped in cross-section having a vertical limb 42 and a transverse limb 45 which extends with clearance C1 beneath the guide rail 34 into sliding contact with the backplate 30. The limb 45 has an inclined lower abutment surface 46.

The second wedge shaped member 48 is generally T-shaped in cross-section having a vertical limb 50 slidably disposed between the vertical limb 42 of the first wedge shaped member 41 and the guide rail 34. The second wedge shaped member 48 also has a transverse upper limb 52 which extends with clearance C2 over the limb 42 and over the guide rail 34 into sliding contact with the backplate 30. The transverse limb 52 also has an inclined upper abutment surface 53. The vertical limbs 42, 50 are formed with respective elongate slots 54, 56 through which passes a single mounting pin 58 attached to the guide rail 34 to form a common mounting for the two wedge shaped members 41, 48. The mounting pin 58 has a head 60 which overlies a shoulder 62 surrounding the slot 54 to slidably hold both of the wedge shaped members 41, 48 to the guide rail 34 and, thereby, to the backplate 30.

The backplate 30 has a flange 64 at one end which is used as an abutment for a leaf spring 66.

The leaf spring 66 has first and second resilient curved portions 68, 70 which contact the respective right hand ends (FIG. 2) of the first and second wedge shaped members 41, 48. The first and second resilient curved portions 68, 70 are used to bias the respective first and second wedge members into the position shown in FIG. 2 so that the pin 58 lies at the right hand end of the slot 54.

It should be noted that the first and second wedge members 41, 48 may be slid independently to the right (FIG. 2) against the bias of the resilient portions 68, 70 of the spring 66 so that relative sliding between the two wedge shaped members 41, 48 can occur.

The second member, in the form of a plate 26, is secured, in use, to the door post 20 by means of screws (not shown) which pass through apertures 74 in the plate 26.

The plate 26 is formed with a tapering recess 76 having lower and upper convergent surfaces 78, 80 which terminate at a parallel sided slot 82 having lower and upper surfaces 84, 86. The lower surface 78 is upwardly inclined to form a ramp for cooperation with the roller 38 which acts as an alignment guide during door closing.

In operation, as the door 12 approaches its closed position, the roller 38 enters the recess 76 and if the door 12 has dropped slightly relative to the door post 20 the roller 38 will come into contact with the ramp surface 78 as it moves into the recess 76. A continued closing movement of the door 12 will cause the roller 38 to roll up the upwardly inclined ramp 78 thereby lifting the door 12 and realigning the first and second members 22, 26 and the striker 18 with the latch 16. Further closing of the door 12 causes the roller 38 to roll off the ramp 78 and onto the lower surface 84 of the parallel sided slot 82. It will be noted that the diameter of the roller 38 is less than the distance indicated at d (FIG. 4) between the surfaces 84, 86 of the parallel sided slot 82. Therefore, the top of the roller 38 will remain clear of the surface 86 as it rolls into the slot 82 and will not prevent vertical displacement between the first and second members 22, 26.

Figure 4:
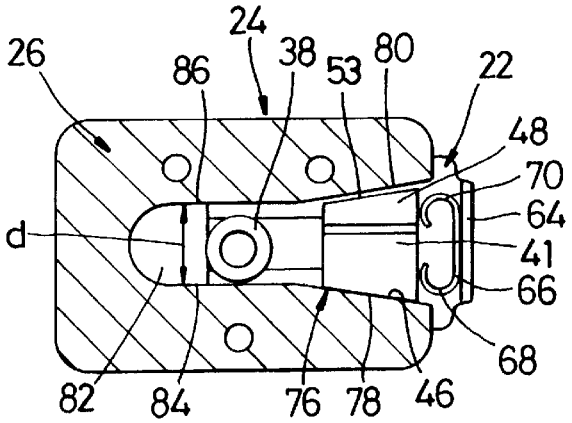
FIG. 4 is a diagrammatic cross-section of the anti-rattle assembly with the door partially closed.
Figure 5:
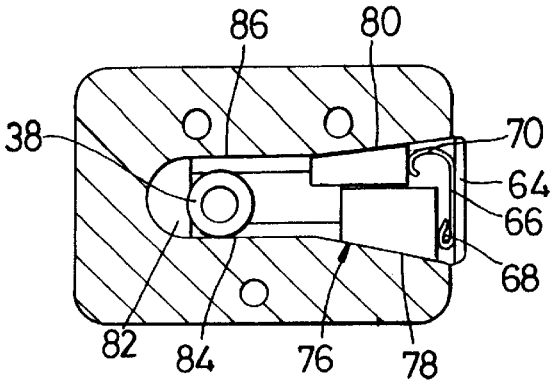
FIG. 5 is a view similar to FIG. 4 with the door fully closed and showing the wedge shaped members of the first member in engagement with a tapering recess formed in the second member.

With reference to FIGS. 4 and 5, it will be appreciated that as the roller 38 enters the slot 82, the lower surface 46, of the first wedge shaped member 41, wedges against the ramp surface 78.

The lower surface 46 is inclined at the same angle as the ramp surface 78 and continued closing movement of the door 12 causes the first wedge shaped member 41 to be slid towards the flange 64 thereby compressing the resilient curved portion 68 of the spring 66. Initially, the second wedge shaped member 48 is not in contact with the recess 76 and so wedge 48 continues to move with the backplate 30 until eventually, the upper surface 53 of the second wedge shaped member 48 wedges against the surface 80 of the recess 76. Similarly, the surface 53 is inclined at the same angle as the surface 80 and further movement of the door 12 toward the closing position will eventually cause the second wedge shaped member 48 to compress the other resilient curved portion 70 of the spring 66 against the flange 64.

Once the latch 16 and striker 18 are fully inter-engaged, the anti-rattle member 40 is wedged in the recess 76 to restrict up and down free movement of the door 12. The clearances C1 and C2 will permit slight pivoting of the wedge members 41, 48 on the mounting pin 58 so as to ensure that the respective outer surfaces 46, 53 of the wedge members 41, 48 will lie flat against the ramp 78 and surface 80.

When the latch 16 is released from the striker 18 and the door 12 is opened, the roller 38 is withdrawn from the slot 82 and the recess 76 and the first and second wedge shaped members 42, 48 of the anti-rattle member 40 slide back into positions shown in FIG. 2 under the bias of the spring 66.

Figure 6:
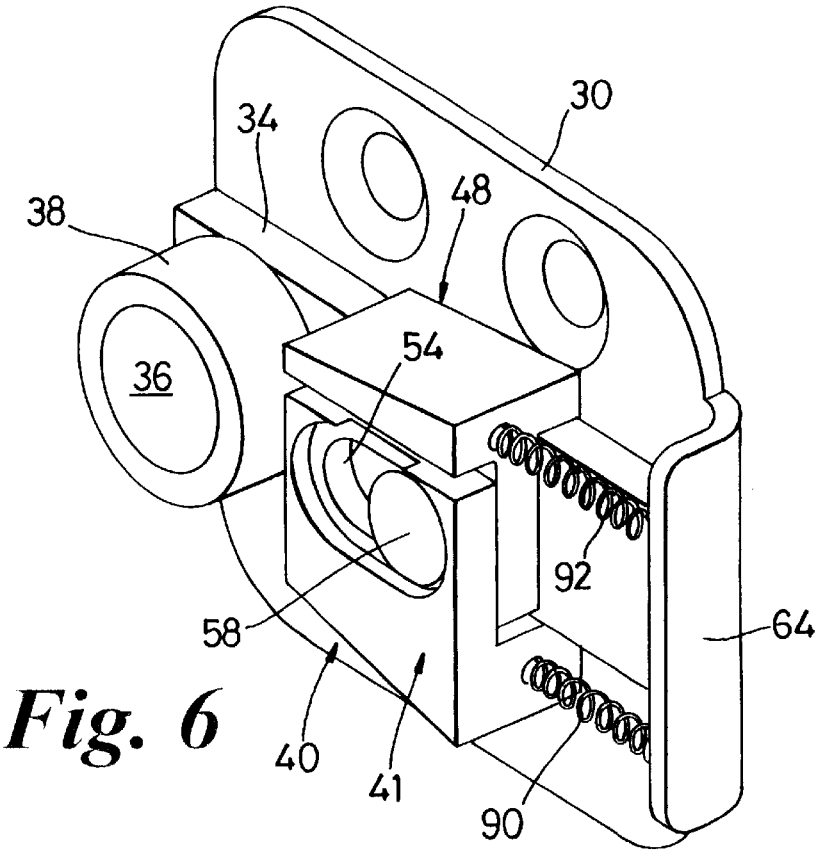
FIG. 6 is a perspective view of the first member with an alternative spring biasing arrangement.
Figure 7:
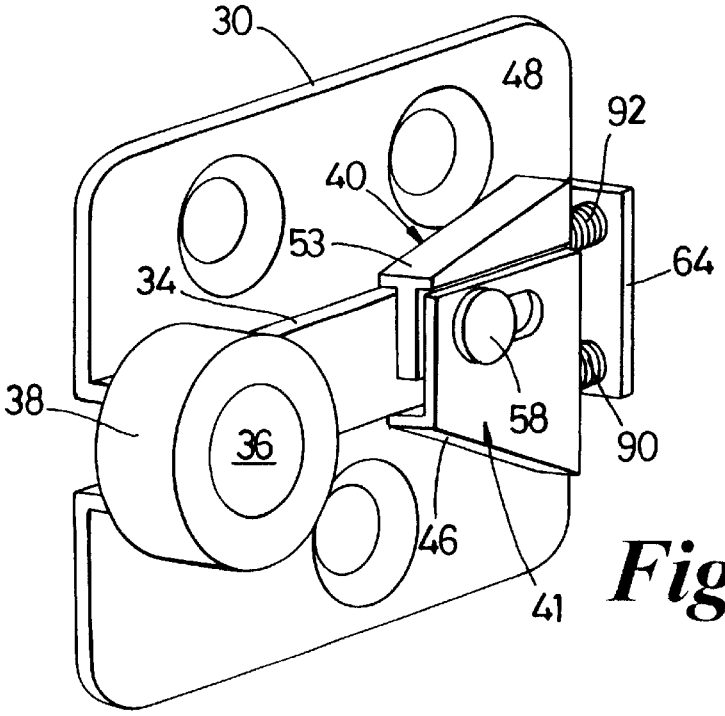
FIG. 7 is a perspective view similar to FIG. 6 of an alternative wedge securing means.

In FIGS. 6 and 7, the anti-rattle assembly is substantially the same as the embodiment shown in FIG. 2 except that the single spring 66 is replaced by two helical coil compression springs 90, 92 which apply the resilient bias to the first and second members 41, 48 of the anti-rattle member 40. Parts in FIGS. 6 and 7 which correspond in construction and function to those in FIGS. 2 and 3 carry the same reference numerals. Operation of the anti-rattle assembly is as described above.

Figure 8:
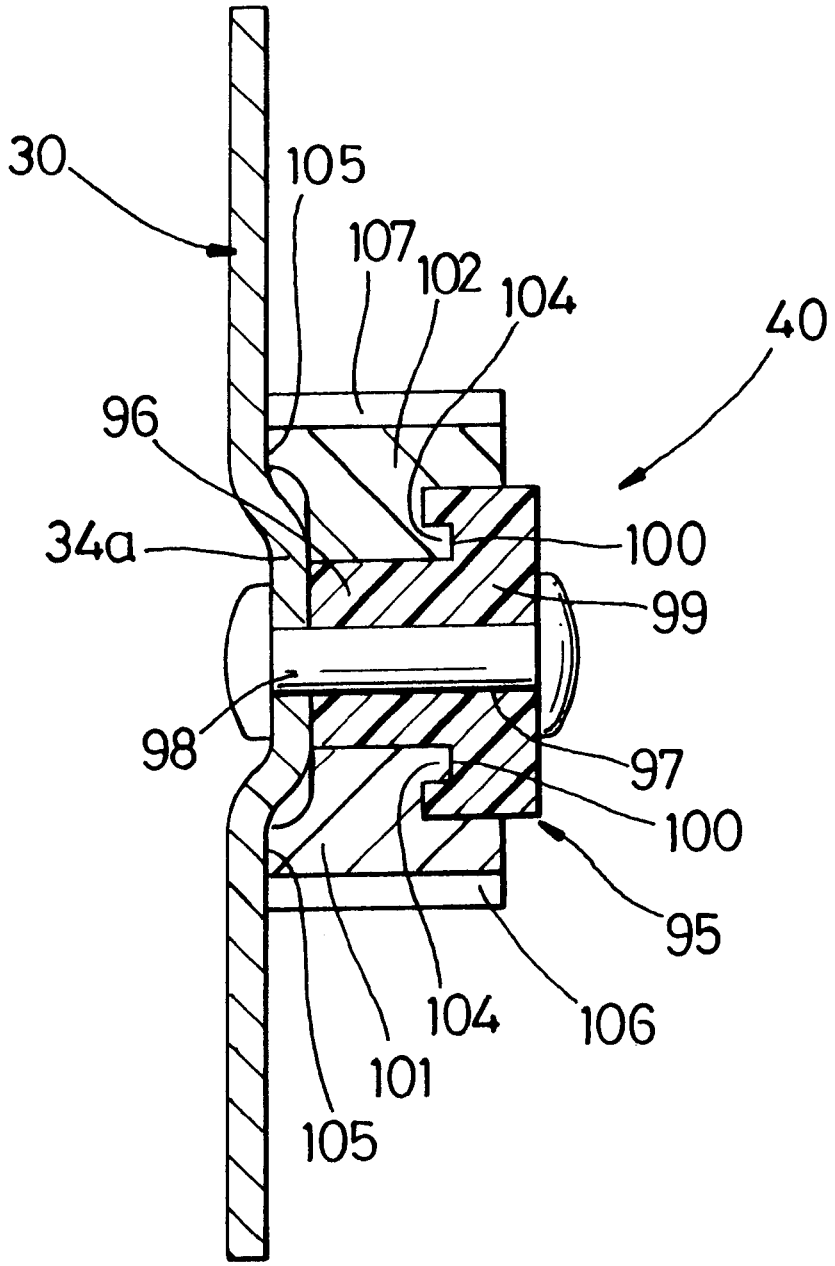
FIG. 8 is a sectional view of an anti-rattle door assembly according to a second embodiment of the invention.

With reference to FIG. 8, there is another embodiment of the anti-rattle assembly according to the invention in which, instead of using an integral guide rail 34 to provide a slide for the anti-rattle member 40, a separate slide block 95 of T-shaped cross-section is provided for two wedge shaped members 101, 102 to slide thereon. A stiffening formation **34*a* is formed as part of the backplate to which the slide block 95** is attached.

The slide block 95 forms a common mounting for the two wedge shaped members 101, 102 forming the anti-rattle member 40.

One limb 96 of the T-shaped slide block 95 is formed with a number of bores 97 for receiving respective rivets 98 by which the slide block 95 is attached to the formation **34*a*. The cross limb 99 of the T-shape is formed with undercuts 100 one for each side of the limb 96**.

The two wedge shaped parts 101 and 102 are formed with respective projections 104 which are slidably located in the undercuts 100. Inner surfaces 105 of the wedge members 101, 102 are in sliding contact with the backplate 30.

The wedge members 101 and 102 have respective inclined surfaces 106, 107 for wedging contact with the surfaces 78, 80 of the second member 26. The parts 101 and 102 are acted upon by a spring means (not shown) so as to enable them to operate in a similar manner to the parts 41, 48 described above.

An alignment guide such as a roller (not shown) is rotatably attached to the backplate 30 as described with reference to FIGS. 2–5 to align the wedge members 101, 102 with the second member 26 during door closing.

It will be appreciated that by providing two independently slidable wedge shaped members it is possible to obtain a better engagement between the first and second members than if a single wedge member is used. Such arrangement further reduces the opportunity for rattling of the door to occur.

It will be appreciated that many components, for example plate 26, blocks 44, 48, slide block 95, may be of a plastics material.

We claim:

1. An anti-rattle assembly for a vehicle door, said anti-rattle assembly comprising:

a first member for attachment to the vehicle door and a second member for attachment to a part of a vehicle defining a door opening, the first member having a backplate for attachment to the vehicle door, at least one wedge-shaped member being slidingly supported by the backplate between a roller member and a spring means for biasing the at least one wedge-shaped member into engagement with the second member, and the second member having a plate defining a tapering recess for cooperation with the at least one wedge-shaped member, and the plate facilitating attachment of the second member to the part of the vehicle defining the door opening;

wherein the roller member is attached to said backplate for engagement with only one surface of said tapering recess during closure of the vehicle door so as to align the first and second members with one another as the vehicle door is closed.

2. An anti-rattle assembly according to claim 1, wherein the tapering recess has a lower surface which is inclined upwardly so as to form a ramp upon which the roller member rides thereby producing an upward force on the first member to bring the first and second members into alignment.

3. An anti-rattle assembly according to claim 1, wherein the roller member is a roller rotatably connected to the backplate.

4. An anti-rattle assembly according to claim 1, wherein the backplate has a flange portion forming an abutment for the spring means.

5. An anti-rattle assembly according to claim 1, wherein said at least one wedge-shaped member comprises two wedge-shaped members independently slidable relative to each other.

6. An anti-rattle assembly according to claim 5, wherein after initial engagement of the first member with the second member, the spring means is operable to encourage sliding between the two wedge members so as to close any clearance between the two wedge members and the tapering recess.

7. An anti-rattle assembly according to claim 5, wherein the spring means is a leaf spring having a first end in engagement with one of said two wedge members, a second end in engagement with the other of said two wedge members and a central portion supported by a flange portion of the backplate.

8. An anti-rattle assembly according to claim 5, wherein the spring means comprises two compression springs each acting upon a respective one of the two wedge members.

9. An anti-rattle assembly according to claim 5, wherein both of the wedge members are slidingly connected to the backplate by a common mounting.

10. An anti-rattle assembly according to claim 5, wherein the backplate comprises a "T" shaped slide block along which the two wedge members are arranged to slide.

11. An anti-rattle assembly according to claim 1, wherein the backplate includes an integral guide rail along which the at least one wedge-shaped member is arranged to slide.

12. A vehicle door having an anti-rattle assembly and a latch mounted on the vehicle door cooperatingly aligned with a striker mounted on a vehicle, the anti-rattle assembly comprising a first member and a second member for attachment to a part of the vehicle defining a door opening, the first member having a backplate attached to the vehicle door, at least one wedge-shaped member slidingly supported by the backplate between a roller member and a spring means for biasing the at least one wedge-shaped member into engagement with the second member, and the second member having a plate defining a tapering recess for cooperation with the at least one wedge-shaped member, and the plate facilitating attachment of the second member to the part of the vehicle defining the door opening;

wherein roller member is attached to said backplate for engagement with only one surface of said tapering recess during closure of the vehicle door so as to align the first and second members with one another as the vehicle door is closed.

13. A vehicle door to claim 12, wherein the tapering recess has a lower surface which is inclined upwardly in a direction of door closing so as to form a ramp upon which the roller member rides during the door closing thereby producing an upward force on the vehicle door to bring the first and second members into alignment.

14. A vehicle door according to claim 12, wherein the roller member is a roller rotatably connected to the backplate.

15. A vehicle door according to claim 12, wherein the backplate has an flange portion forming an abutment for the spring means.

16. A vehicle door according to claim 12, comprising two said wedge-shaped members independently slidable relative to each other.

17. A vehicle door according to claim 16, wherein after initial engagement of the first member with the second member, the spring means is operable to encourage sliding between the two wedge members so as to close any clearance between the two wedge members and the tapering recess.

* * * * *